United States Patent [19]

Brodman et al.

[11] 4,033,798

[45] July 5, 1977

[54] COMPLEX OF NITROCELLULOSE AS PROPELLANT

[75] Inventors: Bruce W. Brodman, Cornwells Heights; Michael P. Devine, Churchville; Stuart Schwartz, Philadelphia, all of Pa.

[73] Assignee: The United States of America as represented by the Secretary of the Army, Washington, D.C.

[22] Filed: Mar. 29, 1976

[21] Appl. No.: 671,475

[52] U.S. Cl. ..... 149/92; 149/96; 536/23

[51] Int. Cl.[2] ..... C06B 25/34

[58] Field of Search ..... 149/92, 93, 96; 260/220

[56] References Cited

UNITED STATES PATENTS

| | | | |
|---|---|---|---|
| 3,925,125 | 12/1975 | Cox et al. | 149/92 X |
| 3,943,017 | 3/1976 | Wells | 149/92 |

*Primary Examiner*—Stephen J. Lechert, Jr.
*Attorney, Agent, or Firm*—Nathan Edelberg; Robert P. Gibson; Kalman Pollen

[57] ABSTRACT

A solution comprising nitrocellulose and a nitramine consisting of either RDX (Hexahydro-1,3,5-trinitro-s-triazine), HMX (Octahydro-1,3,5,7-tetranitro-s-tetrazine), or mixtures thereof is dissolved in a volatile, liquid acetate ester, evaporated at room temperature to form a film, and then dried. The resulting material is a homogeneous, hydrogen-bonded complex of nitrocellulose and the nitramine, useful as an energetic propellant.

7 Claims, No Drawings

COMPLEX OF NITROCELLULOSE AS PROPELLANT

The invention described herein may be manufactured and used by and for the Government of the United States of America for governmental purposes without the payment to us of any royalties thereon.

This invention relates to propellant compositions and to a process for their formation. More particularly, the invention relates to novel, energetic propellant compositions consisting of hydrogen-bonded complexes of nitrocellulose and either RDX or HMX.

Past attempts employing physical mixtures of nitrocellulose and RDX or HMX have proved unsuccessful largely because of the independent burning of the nitramine (HMX or RDX) and nitrocellulose. Thus, most frequently, in firing a gun, for example, the pressures generated by the combustion of nitrocellulose proved insufficient for proper ignition of crystalline nitramine in the propellant. The nitramine, essentially unburned, was discharged from the gun barrel. On the few occasions when substantial combustion of the nitramine did occur, excessive chamber pressures resulted. An advantage of the present invention resides in a homogeneous composition of nitrocellulose with RDX or, alternatively, with HMX.

In the prior art, adduct complexes of HMX were formed with benzene and naphthalene derivatives (aromatic and planar substances) by precipitating the complexes from a solution. That nitrocellulose chains hydrogen bond with other nitrocellulose chains is known. The present invention involves a hydrogen-bonded (non-adduct) complex of the non-aromatic, non-planar, polymeric nitrocellulose with either HMX or RDX formed by completely evaporating a solution containing the complexing agents to form a structure substantially dissimilar in configuration from the aforementioned prior art.

It is an object of the present invention to achieve a homogeneous propellant composition of nitrocellulose and RDX or HMX.

It is a further object of the invention to achieve such a homogeneous propellant composition comprising hydrogen-bonded complexes of nitrocellulose with HMX or with RDX.

A still further object is to achieve such a hydrogen-bonded complex providing increased volumetric impetus for ammunition with concomitant increased projectile velocity.

Briefly, we have discovered a hydrogen-bonded complex of nitrocellulose with RDX and HMX, the complex being formed by completely evaporating a solution of nitrocellulose and either RDX, HMX, or mixtures thereof.

In accordance with the present invention, nitrocellulose is dissolved in a liquid, volatile, acetate ester such, for example, as ethyl acetate, propyl acetate, or amyl acetate. Such acetate esters are desirable solvents because they dissolve both the nitrocellulose and HMX or RDX, and further because they readily evaporate at room temperature. Their evaporation at room temperature eliminates any need for heating the easily ignitable nitrocellulose or the resulting hydrogen-bonded complex. The nitrocellulose used in this invention should have an average molecular weight of at least about 5,000, a convenient upper limit being about 200,000, which limit may be substantially exceeded, however. The nitrogen content of the nitrocellulose may vary from about 5–13.5 percent by weight of the nitrocellulose, and is preferably about 12–13 percent by weight of the nitrocellulose. Below 12 percent by weight nitrogen, a loss of volumetric impetus of the resulting complex occurs. Above 13 percent by weight nitrogen, the number of free hydroxyl groups of the nitrocellulose may be undesirably reduced, the free hydroxyls being necessary for hydrogen bonding of the nitrocellulose with the nitramine and for hydrogen bonding of nitrocellulose chains with each other. The percentage by weight of the complexing RDX may range from about 15–68 percent, the remaining 85–32 percent by weight of the complexing ingredients being nitrocellulose. HMX may range by weight as a complexing ingredient from about 20–74 percent, the nitrocellulose then ranging by weight from about 80–26 percent. It is preferred, however, that the nitramine (HMX or RDX) comprise about 20–30 percent by weight of the complexing ingredients in order to permit substantial hydrogen bonding between nitrocellulose chains of the complex to insure its physical integrity when formed into propellant grains. Below 20 percent by weight nitramine, loss of volumetric impetus may result. It should be borne in mind that the desired volumetric impetus of the complex may be regulated by adjusting the amount of nitramine present therein. Additionally, if desired, our hydrogen-bonded complex may comprise both HMX and RDX hydrogen-bonded to nitrocellulose, in which case the preferred total content by weight of the two complexing nitramines is still about 20–30 percent of the total complex.

In the practice of this invention, solutions of nitrocellulose and nitramine may be incrementally added into a propellant mold, evaporated and dried. Alternatively, solutions of nitrocellulose and nitramine may be introduced into tanks, evaporated to a doughy mass, and then extruded therefrom.

The invention may be better understood by reference to the examples described in Table I and in the following.

Standard nitrocellulose and nitramine solutions of weights and quantities indicated in Table I below were mixed, the resulting solutions evaporated on a salt plate to form cast films. The films were then subjected to a roughing pump vacuum for a minimum of 140 hours. These films were composed of hydrogen-bonded complexes of nitrocellulose and the nitramine (HMX or RDX).

TABLE I

| | Nitrocellulose and Nitramine Solutions | | |
|---|---|---|---|
| Exper. No. | NC & Nitramine Soln. | Soln. Vol. Used of NC to Nitramine | Ratio Wts. of Nitrocellulose to Nitramine |
| 1 | NC (12.6%)[a]-HMX[c] | (1 ml : 3 ml) | 11.2 mg : 7.5 mg |
| 2 | NC (12.6%)[a]-RDX[d] | (1 ml : 1.5 ml) | 11.2 mg : 15.0 mg |
| 3 | NC (12.1%)[b]-HMX[c] | (1 ml : 3 ml) | 12.7 mg : 15.0 mg |

TABLE I-continued

| Exper. No. | Nitrocellulose and Nitramine Solutions: NC & Nitramine Soln. | Soln. Vol. Used of NC to Nitramine | Ratio Wts. of Nitrocellulose to Nitramine |
|---|---|---|---|
| 4 | NC (12.1%)[b]-RDX[d] | (1 ml : 3 ml) | 12.7 mg : 30.0 mg |

[a]NC (12.6%) solution = 1.12 gms NC/100 ml EA
[b]NC (12.1%) solution = 1.27 gms NC/100 ml EA
[c]HMX solution = 0.25 gm HMX/100 ml EA
[d]RDX solution = 1.0 gm RDX/100 ml EA
EA = ethyl acetate
NC = Nitrocellulose
NC (12.6%) = Nitrocellulose wherein the nitrogen content comprises 12.6% by weight of the total weight of nitrocellulose.
NC (12.1%) = Nitrocellulose wherein the nitrogen content comprises 12.1% by weight of the total weight of nitrocellulose.

Table II below indicates the reciprocal of the wavelength characteristic of a hydroxyl of nitrocellulose as measured before and after complexing. Table II also indicates the hydrogen bond length between a hydroxyl of nitrocellulose and an oxygen of the nitramine. The presence of a hydrogen-bonded complex is indicated by the shift in the hydroxyl stretch frequency after complexing, the shift being measured by an infrared spectrophotometer. The hydrogen bond length was determined by the hydroxyl frequency shift using the K. Nakamoto relationship, well known in the art, which is a graphical relationship relating hydrogen bond distance to shifting of the hydroxyl stretch frequency. From the hydrogen bond length and a consideration of the elements capable of participating in hydrogen bonding, it is concluded that hydrogen bonding takes place between a hydroxyl of nitrocellulose and an oxygen of the nitramine. The experiment numbers in Table II correspond to those in Table I, the principal difference being the nitrocellulose and nitramine ingredients in Table II have actually complexed. Controls 1 and 2 are 1 ml samples taken from a solution wherein 1.12 g and 1.27 g, respectively, of nitrocellulose were dissolved in 100 ml ethyl acetate.

TABLE II

| Control | Exper. No. | Sample | ν-OH and Bond Lengths: ν-OH ($cm^{-1}$) | $\Delta\nu$[a] ($cm^{-1}$) | No. Runs | H Bond (Å) Length |
|---|---|---|---|---|---|---|
| 1 | | NC (12.6%) | 3516 | — | 4 | — |
| | 1 | NC (12.6%) - HMX | 3490 | 26 | 3 | 2.90 |
| | 2 | NC (12.6%) - RDX | 3452 | 64 | 3 | 2.87 |
| 2 | | NC (12.1%) | 3506 | — | 4 | — |
| | 3 | NC (12.1%) - HMX | 3444 | 62 | 3 | 2.86 |
| | 4 | NC (12.1%) - RDX | 3422 | 84 | 3 | 2.85 |

[a]$\Delta\nu$ = [ν-OH(NC) minus ν-OH (Sample)]

ν—OH(NC), the control, represents the reciprocal of the wavelength of the hydroxyl stretching frequency of nitrocellulose before hydrogen bonding. ν—OH (Sample) represents the reciprocal of the wavelength of the hydroxyl stretching frequency of nitrocellulose after complexing with the nitramine, or in the case of Control 1 and 2, where no complexing agent is present. ν—OH represents the reciprocal of the wavelength of the hydroxyl stretching frequency of nitrocellulose, and includes both of the previous two cases, complexed and uncomplexed nitrocellulose.

We claim:

1. A chemical complex comprising nitrocellulose hydrogen-bonded to a member selected from the group of hexahydro-1,3,5-trinitro-s-triazine, octahydro-1,3,5,7-tetranitro-s-tetrazine, and mixtures thereof.

2. A chemical complex according to claim 1, wherein said member consists of hexahydro-1,3,5-trinitro-s-triazine, said complex comprising by weight about 15 – 68 percent hexahydro-1,3,5-trinitro-s-triazine and about 85 – 32 percent by weight nitrocellulose.

3. A chemical complex according to claim 1, wherein said member consists of octahydro-1,3,5,7-tetranitro-s-tetazine, said complex comprising by weight about 20 – 74 percent octahydro -1,3,5,7-tetranitro-s-tetrazine and about 80 – 26 percent by weight nitrocellulose.

4. A chemical complex according to claim 1, wherein said complex comprises by weight about 20–30 percent of said member, and about 80–70 percent by weight of nitrocellulose.

5. A chemical complex according to claim 1, wherein said nitrocellulose has a nitrogen content by weight in the range of about 5–13.5 percent.

6. A chemical complex according to claim 1, wherein said nitrocellulose has a nitrogen content by weight in the range of about 12–13 percent.

7. A chemical complex comprising nitrocellulose hydrogen-bonded to a member selected from the group consisting of hexahydro-1,3,5-trinitro-s-triazine, octahydro-1,3,5,7-tetranitro-s-tetrazine, and mixtures thereof, said complex comprising the product of evaporating a solution containing nitrocellulose and said member.

* * * * *